United States Patent [19]

Sonobe et al.

[11] Patent Number: 5,033,380

[45] Date of Patent: Jul. 23, 1991

[54] INKING UNIT WITH HOLLOW MICROBALLOONS IN SURFACE AND METHOD OF MAKING

[75] Inventors: Saburo Sonobe, Toride; Nobuyuki Ishibashi, Matsudo, both of Japan

[73] Assignee: Kinyosha Co., Ltd., Tokyo, Japan

[21] Appl. No.: 329,894

[22] PCT Filed: Sep. 29, 1988

[86] PCT No.: PCT/JP88/00993

§ 371 Date: Mar. 9, 1989

§ 102(e) Date: Mar. 9, 1989

[87] PCT Pub. No.: WO89/02833

PCT Pub. Date: Apr. 6, 1989

[30] Foreign Application Priority Data

Oct. 5, 1987 [JP] Japan ..... 62-250895

[51] Int. Cl.[5] ..... B41F 31/26

[52] U.S. Cl. ..... 101/350; 29/121.8; 29/132; 29/895.32

[58] Field of Search ..... 101/147, 148, 348, 349, 101/350; 29/121.1, 121.8, 132, 895.32

[56] References Cited

U.S. PATENT DOCUMENTS

| | | | |
|---|---|---|---|
| 2,804,678 | 9/1957 | Rockoff | 29/121.8 |
| 3,139,826 | 7/1964 | Rainwater | 101/348 |
| 4,860,652 | 8/1989 | Kawata | 101/348 |

FOREIGN PATENT DOCUMENTS

| | | | |
|---|---|---|---|
| 62-71649 | 4/1987 | Japan . | |
| 167092 | 7/1987 | Japan | 101/348 |
| 949344 | 2/1964 | United Kingdom | 29/132 |

OTHER PUBLICATIONS

"Taga 1989 Proceedings", Worldwide Status and Progress of Lithographic Keyless Inking Technologies, pp. 545 and 566 (1989).

"The Lithographers Manual", Blair et al., Graphic Arts Technical Foundation, Inc., pp. 12–26 through 12–28 (1980).

Elsevier's "Dictionary of the Printing and Allied Industries", p. 489 (1983).

*Primary Examiner*—Clifford D. Crowder

*Attorney, Agent, or Firm*—Nixon & Vanderhye

[57] ABSTRACT

Ink metering rollers include a core roller and a synthetic resin matrix layer formed on the periphery of the core roller. The matrix layer has a number of hemispherical depressions formed in its surface and also a number of hollow microballoons embedded therein. As the matrix layer of the ink metering roller is gradually worn, the hollow microballoons open in the surface of the matrix layer thereby forming spherical depressions. Hence, the spherical depressions are always distributed uniformly in the surface of the matrix layer, and hold a prescribed amount of ink. The ink metering roller therefore uniformly transfers and distributes a desired amount of ink onto the entire periphery of inking rollers associated with keyless printing machines.

13 Claims, 2 Drawing Sheets

INKING UNIT WITH HOLLOW MICROBALLOONS IN SURFACE AND METHOD OF MAKING

FIELD OF THE INVENTION

The present invention relates to an inking unit for use in a printing machine, and also to a method of manufacturing this inking unit.

BACKGROUND AND SUMMARY OF THE INVENTION

Recently so-called "keyless" printing machines, which have no buttons to operate in order to control the ink-supplying rate, have been used in place of conventional printing machines which have a number of ink-supply control buttons. Because of this, conventional machines usually require a skilled operator to control the ink supply rate paper to the ink transfer rollers such that a sheet paper is printed with a uniform density. This is partly because the keyless printing machine is less expensive than the conventional one, and partly because no skilled labor is required to operate the keyless printing machine.

The keyless printing machine will be described, with reference to FIG. 1.

As is shown in FIG. 1, the keyless printing machine comprises ink pan 1 containing ink 2, and an ink fountain roller 4 with its lower part immersed in ink 2. The machine further comprises anilox roller 5 located above ink fountain roller 4 and contacting therewith, doctor blade 6 arranged in contact with anilox roller 5, plate cylinder 7 provided above anilox roller 5, and two inking rollers 8 each arranged in contact with roller 5 and plate cylinder 7.

Ink fountain roller 4 is rotated, thereby to transfer ink from ink pan 1 onto anilox roller 5. Doctor blade 6 is operated to remove an excess of ink 2 from anilox roller 5. Thus, an appropriate amount of ink is transferred from roller 5 onto both inking rollers 8 as roller 5 rotates in contact with inking rollers 8. Inking rollers 8 transfers ink 2 onto plate cylinder 7 as rollers 8 rotate in contact with plate cylinder 7.

Anilox roller 5 comprises a core roller (not shown) and a matrix layer (not shown, either) formed on the periphery of the core roller. The matrix layer is made of either ceramics (e.g., alumina ceramics or tungsten carbide) or a soft metal. A number of patterned cells or depressions 5*a*, which are quadrangular pyramid-shaped as is shown in FIG. 2B, are made in the surface of the layer as is illustrated in FIG. 2A. Alternatively, a number of cells 5*b*, which are shaped like quadrangular frustrum pyramid shaped as is shown in FIG. 3B, are made in the surface of the matrix layer as is illustrated in FIG. 3A. These cells 5*a* or 5*b* are formed by applying a laser beam onto the layer when the layer is made of ceramics, or by rolling a matrix roll, which has a number of projections, on the layer when the later is made of a soft metal. This anilox roller acts as ink metering and transfer roller.

The conventional keyless printing machine and anilox roller have the following drawbacks.

(1) The machine is expensive when the cell of anilox roller 5 are formed by means of a special apparatus such as a laser.

(2) The cell may have different sizes when formed by means of a laser, due to changes in the intensity of the laser beam emitted by the laser. The cell may have different shapes when formed by means of a matrix roll. In either case, the machine cannot print a sheet of paper in an uniform density.

(3) As the outer layer of the anilox roller is worn by the doctor blade, the shapes of the cells will change. Hence, the lifetime of the roller is short.

Accordingly it is the object of the present invention to provide an inking unit which has an anilox roller always having spherical cells in its periphery even if the periphery is worn, and which is inexpensive, and which has a long lifetime, and also to provide a method of manufacturing this inking unit.

DETAILED DESCRIPTION OF THE PREFERRED EXEMPLARY EMBODIMENTS

According to the present invention, there is provided an inking unit comprising an ink pan, an ink fountain roller for forming an ink layer on its periphery, at least one inking roller arranged in contact the ink fountain roller, an ink metering roller for transferring the ink from the ink fountain roller onto the inking roller such that the inking roller supplies the ink to a plate cylinder, and a doctor blade located near the ink metering roller, for removing an excess of the ink from the periphery of the ink transfer roller characterized in that said ink metering roller comprises a core roller and a matrix layer made of a resin and formed on the periphery of the core roller, a number of substantially hollow hemispherical cells are formed in the surface of the matrix layer, and a number of hollow microballoons are embedded within the matrix layer.

Further, according to the present invention, there is provided a method of manufacturing an inking unit comprising an ink pan, an ink fountain roller for forming an ink layer on its periphery, at least one inking roller arranged in contact the ink fountain roller, an ink metering roller for transferring the ink from the ink fountain roller onto the inking roller such that the inking roller supplies the ink to a plate cylinder, and a doctor blade located near the ink metering roller, for removing an excess of the ink from the periphery of the ink metering roller, said method being characterized in that the process of manufacturing said ink metering roller comprises the steps of: adding a hardener, hollow microballoons to a material whose main component is a resin, and mixing the hardener, hollow microballoons, and the material, thereby forming a mixture; pouring the mixture into a mold containing a core roller, and hardening the mixture, thereby forming a matrix layer, which contains the hollow microballoons, on the periphery of the core roller; and grinding the matrix layer such that substantially hollow hemi-spherical depressions are formed in the surface of the matrix layer.

It is desirable that the material of the matrix layer be resistant to ink and detergent. The material may be a synthetic resin such as polyurethane resin, epoxy resin, polyester resin, nylon resin, vinyl chloride resin, phenol resin, urea resin, diallyl phthalate resin, polyamide resin, or polyamideimide resin. The material must be one which mixes well the hollow microballoons and does not thermally set at 10° to 80° C. Also, it should preferably have hardness ranging from 70 to 90 as measured by Shore D durometer.

The hollow microballoons, which will form the depressions, are made of either an inorganic material or an organic material. The inorganic material may be, for example, alumina, silica, aluminosilicate, glass or ceramics. The organic material may be, for example, polyvinylidene chloride or phenol resin. The hollow microballoons should have a diameter of 5 to 100 μm, preferably 20 to 80 μm. If the diameter is less than 5 μm, the ink will be supplied from the ink transfer roller to the inking roller in an insufficient amount, and the sheet of paper will be inevitably printed in too low a density. Conversely, if the diameter exceeds 100 μm, the ink will be supplied from the ink transfer roller to the inking roller in an excessive amount, and the sheet of paper cannot be printed in an uniform density.

It is preferable that hollow microballoons be used in an amount ranging from 10 to 400 parts by weight per 100 parts by weight of the layer whose main component is an a synthetic resin. If the hollow microballoons are used in an amount of less 10 parts by weight, less depressions than necessary will be formed in the surface of the matrix layer, and the ink metering roller will not be able to hold a sufficient amount of ink. If the hollow microballoons are used in an amount of more 400 parts by weight, more depressions than necessary will be formed in the surface of the matrix layer, and the ink metering roller will not be able to hold an appropriate amount of ink.

Various methods can be performed to form the matrix layer on the periphery of the core roller. Among these methods are: a cast molding, a rotational molding, a sheet-winding, a reaction injection molding (RIM), and a flame spraying.

The cast molding method is used when the material of the matrix layer is available in the form of a liquid. In this method, the material, the hollow microballoons, and a hardener are mixed, thus forming mixture. The mixture is degassed. An adhesive is coated on a core roller. The adhesive-coated core roller is set in place within a mold. The degassed mixture is poured into the mold and is let to stand until it becomes sufficiently hard, thus forming a matrix layer on the core roller. After this, the matrix layer is ground, whereby hollow hemi-spherical depressions are formed in the surface of the matrix layer. As a result, the ink transfer roller is made.

The rotational molding method is also employed when the material of the matrix layer is available in the form of a liquid. In this method, a hollow cylindrical mold is used. The inner periphery of mold is polished, and the polished inner periphery of the mold is coated with a mold-releasing agent. Then, a measured amount of the mixture, which is identical to that used in the cast molding method, is poured into the cylindrical mold. The mold is spinned for a prescribed time, while the mixture is being hardened at a predetermined temperature. As a result, a matrix layer is formed on the inner periphery of the hollow cylindrical layer. The matrix layer, which is in the form of a hollow cylinder, is released from the mold, and its inner periphery is polished. A core roller is inserted into the cylinder of the matrix layer. The resultant structure is subjected to shrink fitting. Thereafter, the outer surface of the matrix layer is ground, whereby hemispherical depressions are formed in the surface of the matrix layer. As a result, the ink metering roller is made.

The sheet-winding method is used when the material of the matrix layer is available in the form of a solid which has been prepared by mixing the hollow microballoons, a cross-linking agent, and necessary additives such as a processing aid, with a synthetic resin, kneading the resultant mixture by mixing roller, and calendering or injection-molded the kneaded mixture into a sheet. In the sheet-winding method, the sheet is wound around the core roller. The roller is heated-treated, thereby forming a matrix layer integral with the core roller. Then, the surface of the matrix layer is ground, whereby hemi-spherical depressions are formed in the surface of the matrix layer. As a result, the ink metering roller is made.

In the method of making the ink transfer roller, use is made of either a grinding stone or a grinding cloth in order to grind the outer surface of the matrix layer.

The present invention has been made on the basis of the following finding of the inventors.

As has been described, in a keyless printing machine, the ink fountain roller supplies ink from the ink pan to the ink metering roller, the doctor blade removes an excess of ink from the ink transfer roller, an appropriate amount of ink is thus transferred from the inking rollers, and the ink is supplied from the inking rollers onto the plate cylinder. To transfer an appropriate amount of ink to the inking rollers, the ink metering roller must have depressions in its surface. In addition, in order to transfer the ink to the inking roller in an uniform distribution all over the periphery of either inking roller, the depressions must evenly distributed on the surface of the ink metering roller.

Therefore, the inventors worked together to find the best possible method of forming depressions in an uniform distribution all over the surface of the ink metering roller. The first method they proposed is to add a blowing agent to the main component of the material of the matrix layer, i.e., a synthetic resin, then to heat the material to a temperature above the decomposition point of the blowing agent, thus causing the resin to generate nitrogen gas and forming micropores in the matrix layer, and finally to grind the surface of the matrix layer, thus forming depressions in the surface of the layer. However, this method has several problem. First, it is difficult to harden and foam the material at appropriate speeds. If the material is hardened faster than it is foamed, the resultant micropores are too small. Conversely, if the material is foamed faster than it is hardened, the resultant micropores are too large. Secondly, if the foaming proceeds excessively, micropores will aggregate, inevitably forming elongated pores, into which ink will remain adversely. Thirdly, it is difficult to control the foaming of the material such that depressions having a desired size are formed.

The inventors at last invented a new method which solves the problems inherent in the method explained above. In this new method, hollow microballoons having a predetermined diameter are embedded in the matrix layer, and the surface of the layer is ground until depressions are formed in the surface of the layer.

BRIEF DESCRIPTION OF THE ACCOMPANYING DRAWINGS

EXAMPLES

Embodiments of the present invention will now be described.

EXAMPLE 1

One hundred parts by weight of epoxy resin (tradename: Araldite AY103 manufactured by Ciba-Geigy) and 5 parts by weight of silica used as nonsagging agent (tradename: Carplex #80 manufactured by Shionogi Seiyaku) were mixed for 5 minutes by means of a paint mill, thus forming a mixture. Then, this mixture and 30 parts by weight of hollow microballoons made of aluminosilicate (tradename: Fillite manufactured by Fillite, Inc.) and having an average diameter of 45 μm were mixed and stirred. A steel core roller, which had been scaled by means of sand blasting or a similar method, was degreased with trichloroethylene and inserted into a hollow cylinder having an inside diameter 20 mm greater than the diameter of the core roller. The core roller was placed concentric to the hollow cylinder, by means of jigs. The lower end of the cylinder was closed with a cover.

Figure 5:
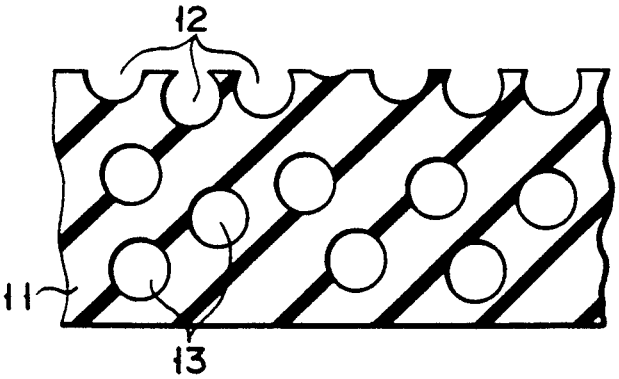
FIG. 5 is a sectional view of the ink metering roller of the inking unit according to the present invention.

Then, 17 parts by weight of hardener (tradename: Hardener HY956 manufactured by Ciba-Geigy) was added to the mixture containing the hollow microballoons. The hardener and the mixture were stirred together. After taking off the foam of the mixture, the mixture was poured into the gap between the core roller and the cylinder. The upper end of the cylinder was closed with a cover, and the mixture within the cylinder was left to stand for 24 hours, whereby the mixture was hardened, thus forming a resin layer on the periphery of the core roller. The core roller, with the resin layer formed on its periphery, is released from the cylinder. The resin layer was grounded by the known method, thus forming an anilox-like roller 5 having a matrix layer whose thickness was 8 mm and which had a cross section illustrate in FIG. 5. As is shown in FIG. 5, hemispherical depressions 12 were formed in resin layer 11, and hollow microballoons 13 were formed within resin layer 11. The surface hardness of this anilox roller-like was measured by the Shore D durometer; it was 80. Another identical anilox-like roller was also manufactured in the same way.

Figure 1:
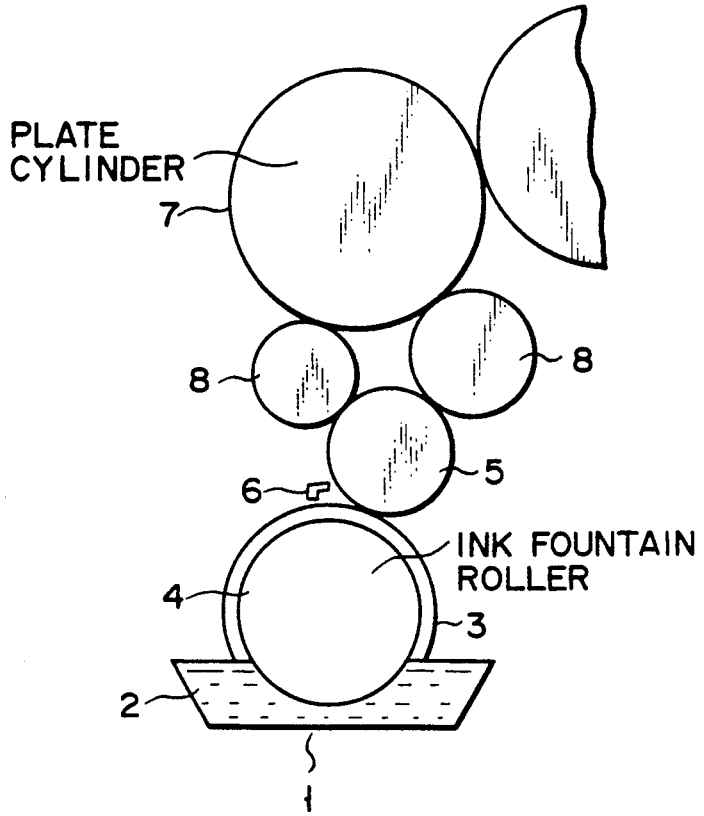
FIG. 1 (Prior Art)
FIG. 1 is a schematic representation of a conventional inking unit.
Figure 2A:
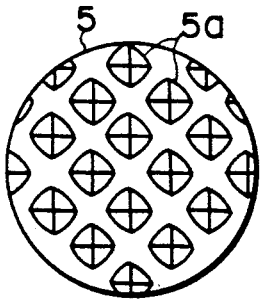
FIG. 2A (Prior Art)
FIGS. 2A and 2B are diagrams showing the depressions formed in the periphery of the anilox roller used in a conventional keyless printing machine.
Figure 2B:
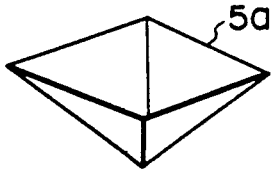
FIG. 2B (Prior Art)
Figure 3A:
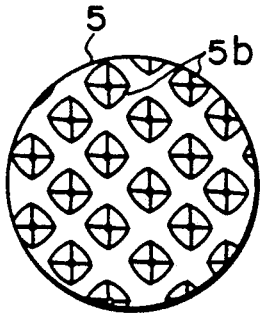
FIG. 3A (Prior Art)
FIGS. 3A and 3B are diagrams showing the depressions formed in the periphery of the anilox roller used in another prior art keyless printing machine.
Figure 3B:
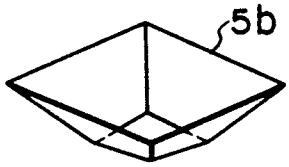
FIG. 3B (Prior Art)
Figure 4:
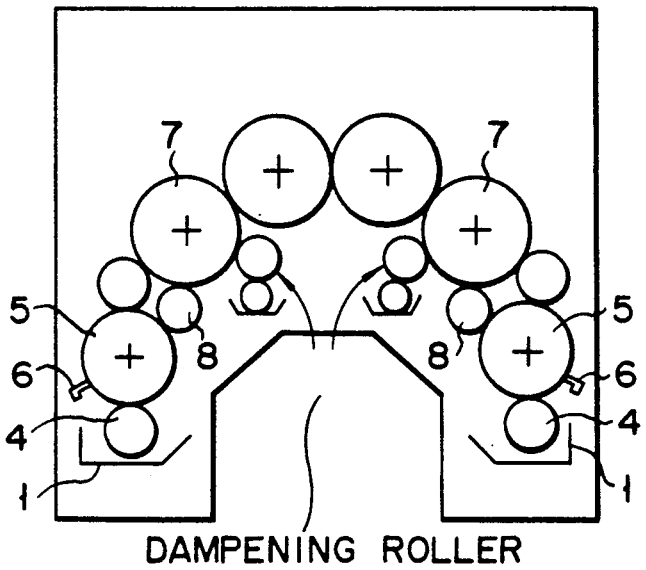
FIG. 4 is a diagram schematically showing a printing machine in which an inking unit according to the invention is used.

This ink transfer roller was incorporated into the keyless printing machine shown in FIG. 4. The printing machine was operated to print sheets of papers. The prints were clearer than those made by the keyless printing machine provided with the conventional anilox rollers.

Ink metering roller 5 of either inking unit according to the invention comprises a core roller and matrix layer 11 made of a resin and having a number of hemi-spherical depressions 12 formed in its surface and a number of hollow microballoons 13 embedded in it. As matrix layer 11 is gradually worn as roller 5 is used, hollow microballoons 13 open in the surface of layer 11, thus forming new hemi-spherical depressions. Hence, spherical depressions 12 are always distributed unformly in the surface of matrix layer 11 and hold a prescribed amount of ink. Ink metering roller 5 therefore transfers ink in a desired amount onto the inking rollers of a keyless printing machines, in a uniform distribution all over the peripheries of the inking rollers, thereby serving to achieve high-quality printing.

As has been described, the present invention provides an inking unit and a method of manufacturing the same. The inking unit comprises an ink metering roller whose surface condition remains unchanged even if its surface is worn, since new spherical depressions are formed in the surface as the surface is worn gradually. The inking unit is therefore suitable for use in various types of printing machines, such as flexographic, offset, and relief printing machines.

We claim:

1. An inking unit comprising:

an ink pan, an ink fountain roller in contact with the ink in the ink pan so as to form an ink layer on its periphery, at least one inking roller adapted to transferring ink to a plate cylinder, an ink metering roller operatively interposed between said fountain roller and said inking roller for transferring the ink for the ink fountain roller onto the inking roller such that the inking roller supplies the ink to the plate cylinder, and a doctor blade in contact with an exterior peripheral surface of the ink metering roller for removing excess ink from the periphery of the ink metering roller, wherein said ink metering roller is comprised of a core roller and a matrix layer formed on the periphery of the core roller, said matrix layer consisting essentially of a synthetic resin having a Shore D hardness of between 70 and 90 and including a number of hollow microballoons embedded within said synthetic resin of said matrix layer, and wherein a number of said hollow microballoons are opened at the peripheral surface of said ink metering roller to thereby form hemispherical depressions disposed circumferentially on said peripheral surface of said matrix layer while others of said hollow microballoons remain embedded within said matrix layer and available to be opened in response to sufficient wear of said peripheral surface by means of the doctor blade in contact therewith.

2. The inking unit according to claim 1, wherein said matrix layer is made of a material selected from the group consisting of polyurethane resin, epoxy resin, polyester resin, nylon resin, vinyl chloride resin, phenol resin, urea resin, diallyl phthalate resin, polyamide resin, and polyamide-imide resin.

3. The inking unit according to claim 1, wherein said substantially hemi-spherical depressions and said hollow microballoons have a diameter ranging from 5 to 100 μm.

4. The inking unit according to claim 1, wherein said substantially hemi-spherical depressions are formed by grinding and opening said hollow microballoons.

5. The inking unit according to claim 4, wherein said hollow microballoons are made of a material selected from the group consisting of alumina ($Al_2O_3$), silica ($SiO_2$), aluminosilicate, glass, and ceramics.

6. The inking unit according to claim 4, wherein said hollow microballoons are made of polyvinylidene chloride or phenol resin.

7. The inking unit according to claim 1, wherein said hollow microballoons are embedded in said matrix layer at a depth of at least 2.5 μm from the surface of said matrix layer.

8. A method of manufacturing an inking unit comprising an ink pan, an ink fountain roller in contact with the ink in the ink pan so as to form an ink layer on its periphery, at least one inking roller adapted to transferring ink to a plate cylinder, an ink metering roller operatively interposed between said fountain roller and said inking roller, and a doctor blade in contact with an exterior peripheral surface of the ink metering roller, said process comprising the steps of:

(A) manufacturing and providing the ink metering roller by the steps of;

adding hollow microballoons to a synthetic resin;

adding a hardener to said synthetic resin in an amount sufficient to achieve a Shore D hardness of between 70 and 90;

mixing the hardener, hollow microballoons, and the synthetic resin thereby forming a mixture;

pouring the mixture into a mold containing a core roller, and hardening the mixture about the periphery of the core roller thereby forming a hardened matrix layer having a Shore D hardness of between 70 and 90 and in which the hollow microballoons are embedded; and then subsequently grinding said matrix layer to open those microballoons on a peripheral surface of said matrix layer to thereby form substantially hemi-spherical depressions in the peripheral surface of said matrix layerwhile others of said microballoons remain embedded in said synthetic resin matrix layer and are thereby available to be opened in response to sufficient wear of said peripheral surface;

(B) interposing the ink metering roller between the fountain roller and the inking roller; and (C) operating the inking unit so that said ink is transferred by the ink metering roller from said ink fountain roller and onto the inking roller which, in turn, supplies ink to the plate cylinder for printing upon a substrate, wherein said step of operating the inking unit also includes the steps of:

(i) positioning a doctor blade closely adjacent the peripheral surface of the ink metering roller so as remove excess ink therefrom; and (ii) allowing at least some of the embedded other hollow microballoons to be opened at the peripheral surface of the ink metering roller in response to sufficient wear of the peripheral surface.

9. The method according to claim 8, wherein said matrix layer is made of a material selected from the group consisting of polyurethane resin, epoxy resin, polyester resin, nylon resin, vinyl chloride resin, phenol resin, urea resin, diallyl phthalate resin, polyamide resin, and polyamide-imide resin.

10. The method according to claim 8, wherein said substantially hemi-spherical depressions and said hollow microballoons have a diameter ranging from 5 to 100 $\mu$m.

11. The method according to claim 8, wherein said hollow microballoons are made of a material selected from the group consisting of alumina ($Al_2O_3$), silica ($SiO_2$), aluminosilicate, glass, and ceramics.

12. The method according to claim 8, wherein said hollow microballoons are made of polyvinylidene chloride or phenol resin.

13. The method according to claim 8, wherein said hollow microballoons are used in an amount of 10 to 400 parts by weight per 100 parts by weight of the resin which is the main component of said matrix layer.

* * * * *